US010421527B2

(12) United States Patent
McKellar et al.

(10) Patent No.: US 10,421,527 B2
(45) Date of Patent: Sep. 24, 2019

(54) STANDUP PADDLEBOARD WITH VIEWPORT

(71) Applicant: SUPMARINE, LLC, San Juan, PR (US)

(72) Inventors: Steven Scott McKellar, Chelen, WA (US); Mark Everett McKellar, St. Thomas, VI (US)

(73) Assignee: SUPMARINE, LLC, San Juan, PR (US)

( * ) Notice: Subject to any disclaimer, the term of this patent is extended or adjusted under 35 U.S.C. 154(b) by 43 days.

(21) Appl. No.: 15/388,975

(22) Filed: Dec. 22, 2016

(65) Prior Publication Data

US 2017/0174299 A1 Jun. 22, 2017

Related U.S. Application Data

(60) Provisional application No. 62/270,822, filed on Dec. 22, 2015.

(51) Int. Cl.
*B63C 11/49* (2006.01)
*B63B 35/79* (2006.01)

(52) U.S. Cl.
CPC ..... *B63C 11/49* (2013.01); *B63B 35/79* (2013.01); *B63B 35/7906* (2013.01); *B63B 2231/40* (2013.01)

(58) Field of Classification Search
CPC ..... B63C 11/48; B63C 11/49; B63B 35/79; B63B 35/7903; B63B 35/7906; B63B 35/7909
USPC ..... 441/135; D21/769, 803
See application file for complete search history.

(56) References Cited

U.S. PATENT DOCUMENTS 2,075,649 A * 3/1937 Knight ..... B63B 35/74 359/895
3,042,945 A * 7/1962 Saeman ..... B63B 35/74 441/135
3,185,125 A 5/1965 Haman
4,691,658 A * 9/1987 New ..... B63C 11/49 114/66
4,840,592 A * 6/1989 Anderson ..... B63C 11/49 114/66
4,844,595 A * 7/1989 Nealy ..... G02B 23/22 114/66
4,925,417 A * 5/1990 Warren ..... B63C 11/49 114/66
5,476,055 A 12/1995 Hackett et al.
D377,072 S 12/1996 Ilejay
D378,692 S 4/1997 Lincoln
6,142,844 A 11/2000 Klauber
(Continued)

FOREIGN PATENT DOCUMENTS

WO WO-9418067 A1 * 8/1994 ..... B63C 11/49

*Primary Examiner* — Ajay Vasudeva
(74) *Attorney, Agent, or Firm* — Dorsey & Whitney LLP

(57) ABSTRACT

The present disclosure is directed to a personal watercraft, such as a standup paddleboard, provided with a viewing window that allows the user to view the underwater environment. The viewing window may be watertight and constructed from at least two durable, transparent panels. The area between panels may be sealed from air and water infiltration. A user may add waterproof lights to the bottom of the standup paddleboard in order to allow viewing of the underwater marine environment at night.

20 Claims, 10 Drawing Sheets

(56) References Cited

U.S. PATENT DOCUMENTS

| | | | | |
|---|---|---|---|---|
| 6,241,569 | B1 | 6/2001 | Harkrider et al. | |
| 6,572,424 | B2 * | 6/2003 | Harkrider | B63C 11/49 114/66 |
| D503,206 | S | 3/2005 | Debold et al. | |
| 7,007,628 | B1 | 3/2006 | Conley | |
| 7,927,164 | B2 | 4/2011 | Kuchler et al. | |
| 8,808,047 | B2 | 8/2014 | Knutson | |
| 8,882,554 | B2 | 11/2014 | McKinney | |
| 9,327,807 | B1 * | 5/2016 | Masson | B63B 35/7906 |
| 9,516,949 | B2 * | 12/2016 | Harkrider | A47C 15/006 |
| D785,738 | S | 5/2017 | McKellar et al. | |
| 9,878,765 | B2 * | 1/2018 | McCracken | B63C 11/49 |
| 2005/0064774 | A1 | 3/2005 | Grune et al. | |
| 2005/0247248 | A1 | 11/2005 | Caplan et al. | |
| 2006/0094315 | A1 | 5/2006 | Brodsky | |
| 2006/0252318 | A1 | 11/2006 | Krantz | |
| 2013/0065465 | A1 * | 3/2013 | Montana | B63C 11/49 441/135 |
| 2013/0280974 | A1 | 10/2013 | Mulvihill | |
| 2015/0133011 | A1 | 5/2015 | Imparato | |

* cited by examiner

STANDUP PADDLEBOARD WITH VIEWPORT

CROSS-REFERENCE TO RELATED APPLICATIONS

This application claims the benefit of priority under 35 USC § 119(e) of U.S. Provisional Patent Application No. 62/270,822 filed 22 Dec. 2015 and entitled "Standup Paddleboard With Viewport," which is hereby incorporated by reference in its entirety.

TECHNICAL FIELD

The technology described herein relates to personal watercraft, such as surfboards, kayaks, and the like, for personal recreation, transportation, sport.

BACKGROUND

In recent years, the advent of new materials and construction has led to the increasing popularity of personal watercraft. Whether on vacation or for exercise and sport, personal watercraft offer a fun, diverse way to enjoy the water. One type of personal watercraft is a standup paddleboard which allows the user to stand up and use a paddle to propel the paddleboard. As a result, the user has a unique vantage point compared with other personal watercraft, such as canoes, kayaks, rafts, or the like. However, standup paddleboards are generally constructed of a buoyant opaque material. Accordingly, while a user may have a wide field of view above the water, the user will have essentially no ability to see the area beneath the board. Therefore, there is a need for a paddleboard which allows a user to view the underwater environment.

The information included in this Background section of the specification, including any references cited herein and any description or discussion thereof, is included for technical reference purposes only and is not to be regarded subject matter by which the scope of the present disclosure as defined in the claims is to be bound.

BRIEF SUMMARY

Embodiments of the present disclosure may include a standup paddleboard. The standup paddleboard may include a body having a standing surface and an opposing bottom surface, a window aperture defined through the body and extending between the standing surface and the bottom surface, and a viewport assembly. In some embodiments, the viewport assembly may include a first panel coupled to the standing surface and a second panel coupled to the bottom surface, the first and second panels sealing the window aperture from air and water infiltration.

In one example, the first panel and the second panel may be substantially planar. In another example, the first panel and the second window panel may be made of polycarbonate. In another example, the first panel may be coupled to the standing surface with at least one first fastener, and the second panel may be coupled to a reinforcement structure provided in the window aperture. In another example, each of the first and second panels may be transparent. In another example, the first panel may overhang the perimeter of the window aperture to form a bezel via which the first panel is coupled to the standing surface. The first panel may be at least partially recessed into the standing surface of the body. In another example, the second panel may be at least partially recessed within the bottom surface of the body. The second panel may be secured to one or more reinforcement members positioned within the window aperture. The second panel may be flush with the bottom surface of the body. In another example, the connection between the body and each of the first and second panels may be sealed via a sealing member positioned at least partially between the body and each of the first and second panels. In another example, the standup paddleboard may include a debris barrier coupled to the bottom surface of the body to limit underwater debris from covering the second panel. The debris barrier may direct the underwater debris around the second panel.

Embodiments of the present disclosure may include a viewport assembly kit for a standup paddleboard. The kit may include a top panel arranged to engage a top surface of the standup paddleboard, a bottom panel arranged to engage a bottom surface of the standup paddleboard, and a plurality of connection panels coupleable or formed together to form a hollow space therebetween. In some embodiments, the top and bottom panels may be coupleable to the plurality of connection panels to define a viewport assembly through the standup paddleboard. The bottom panel may be larger than the top panel.

Embodiments of the present disclosure may include a method of assembling a standup paddleboard. The method may include defining a window aperture through a body of the standup paddleboard and coupling a viewport assembly within the window aperture for viewing an environment beneath the standup paddleboard.

In one example, positioning the viewport assembly within the window aperture may include coupling a top panel to a top surface of the standup paddleboard, and coupling a bottom panel to a bottom surface of the standup paddleboard. In another example, the window aperture may be defined during manufacturing of the standup paddleboard.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present disclosure as defined in the claims is provided in the following written description of various embodiments of the present disclosure and illustrated in the accompanying drawings.

DETAILED DESCRIPTION

The present disclosure is generally directed to a standup paddleboard (hereinafter "SUP") provided with a viewport or window which allows the user to view the environment beneath the SUP (such as an underwater or marine environment) clearly and safely while using the SUP. In one example, the SUP has a top surface or platform for the user to stand on and a viewport defining a window through the top surface and body of the SUP. The viewport assembly may have panels constructed of a durable, transparent material, which allows a user to not only view the underwater environment while using the SUP, but also the viewport is sufficiently strong to support a user standing directly on top of the viewport. The viewport assembly further is configured to prevent water leakage in the viewing area, to ensure a clear view for the user, as well as to be easily disassembled to allow replacement of the entire board or discrete components as needed. Further, the viewport assembly is durable enough to withstand the forces of water on a bottom surface and the weight of a user on a top surface.

In one embodiment, the viewport assembly is placed forward of where the user stands on the SUP. For example, in some embodiments, the rear portion of the SUP may include a grip portion, such as rubber skid-free surface with friction enhancing features (e.g., rubber bumps or ridges or the like) that defines a standing area for the user and the viewport assembly is positioned forward of the grip portion. This embodiment allows a user to stand securely on the SUP, while having an angled viewpoint through the viewport assembly to the underwater environment.

Figure 1A:
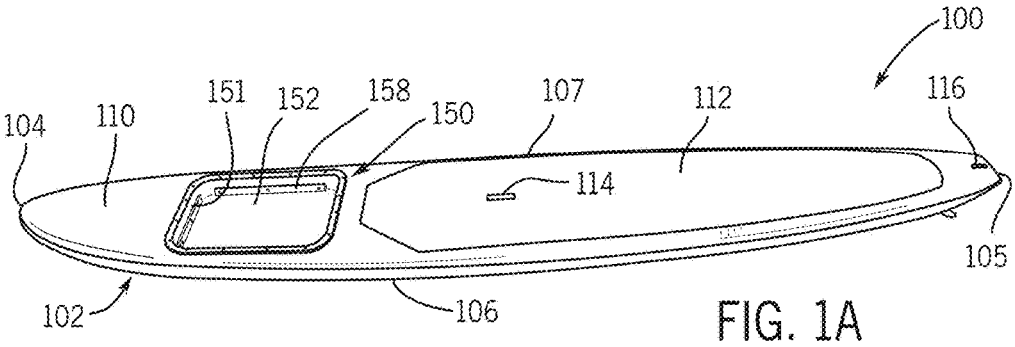
FIGS. 1A-1D are various perspective views of a standup paddleboard according to an example of the present disclosure.

A SUP 100 according to an example of the present disclosure is depicted in FIGS. 1A-1D. FIG. 1A depicts a perspective view of the SUP 100. With reference to FIG. 1A, the SUP 100 includes a body 102 with a tip portion 104, a rear edge 105, a left side 106, and a right side 107 forming a perimeter of the body 102. A platform or top surface 110 of the body 102 includes a handle 114 and a grip portion 112 formed over a substantial portion of the top surface 110. The top surface 110 corresponds to a standing surface. In particular, the grip portion 112 formed over the top surface 110 provides a stable and secure standing surface for a user of the SUP 100. The body 102 may be formed of a buoyant opaque material, such as a foam material, fiberglass, wood, epoxy, and/or carbon fiber or composites and combinations thereof.

The body 102 may have a generally oblong shape that bulges outward or is wider between sides 106, 107 at an intermediate portion between the tip portion 104 and the rear edge 105. The body 102 may also bulge outward or extend outwards from a center area in a depth direction due to a contoured bottom surface 120 opposite the top surface 110. That is, the bottom surface 120 may have a slightly convex shape, while the top surface 110 may be substantially flat. However, in some examples, the top surface 110 may have a contoured shape in the width, depth, and/or length direction. Compared with surfboards and other personal watercraft, this increased width and depth provides a more stable platform for a user to allow a user to stand on top of the surface. Further, due to the increased size compared to other types of personal watercraft, such as surfboards or boogie boards, the body 102 may be heavier which may also increase stability when in use. Typically, as the overall size of the SUP 100 increases, the SUP 100 will be more stable as a result of the increased surface area interfacing with the water. The tip portion 104 may form an apex or may be substantially rounded. The rear edge 105 may be a non-contouring or blunt portion, as shown, or may have substantially any shape such as a contouring shape, geometrical shapes, and combinations thereof. A window aperture 151 is defined through the body 102. The window aperture 151 may be pre-fabricated during the manufacturing of the SUP 100 or may be machined or cut into the SUP 100 after manufacturing. Reinforcement members 158 may be shaped, or excluded from cutting, when forming the window aperture 151 in the body 102. Alternatively, the reinforcement members 158 may be coupled to the body 102 by a fastening device such as nail, screw, adhesive, or the like. The window aperture 151 may have rounded corners to increase structural rigidity and reduce separation of panels 152,153, as well as form a tighter fit, as compared with fitting the panel with butt joints (square-shaped joints or corners).

The bottom surface 120 (see FIG. 1C) defines a floating surface and is in contact with the water. The bottom surface 102 thus is shaped to interface with the water surface and provide buoyancy for the SUP 100. In one example, the bottom surface 120 may have a generally convex, contoured shape with a bulging section in an intermediate portion between a tip portion 104 and rear edge 105 that generally matches the contoured perimeter shape of the top surface.

The handle 114 of the SUP 100 provides a user with the ability to more easily grip the SUP 100 during transportation and/or use. In one embodiment, the handle 114 is recessed into the body 102 so as to not protrude above the top surface 110 of the SUP 100. In this embodiment, the recessed handle 114 does not interfere with a user while the user is standing or sitting on the SUP during use, but is still accessible to allow the SUP 100 to be transported. The recess of the handle 114 may formed as a hole or bore through the grip portion 112 and at least a portion of the body 102. Alternatively, the handle 114 may be a pivoting or retractable component having a first position that protrudes outward from the top surface 110 of the SUP 100 and a second position retracted into the body 102. Further, the handle portion 114 may be provided at any location to facilitate easy carrying by the user, such as at or near the center of gravity of the SUP 100.

The grip portion 112 may be applied and secured to the top surface 110 of the SUP 100 in any conventional manner, including adhering with an adhesive, nailing, screwing, stapling, or the like. In an alternative example, the grip portion may be inlaid or integrally formed with the body 102 of the SUP 100. Typically, the grip portion 112 is a material having a high friction coefficient or one that includes gripping features, such as a gripping pattern, raised protrusions or ridges, or the like. In these embodiments, even in marine and other water environments, the grip portion 112 provides friction to help ensure a user may more securely stand on the SUP 100, even as water washes over the top surface. In some examples, the grip portion 112 may be a layer of rubber, silicone, sandpaper-like material, or the like, secured to or integrated with the top surface 110. The grip portion 112 may be positioned or formed over a substantial portion of the top surface 110 of the SUP 100. In some examples, the grip portion 112 covers approximately two-thirds of the top surface 110 (see FIG. 1A) and may be shaped in substantially any shape, but generally may approximately follow at least a portion of the top surface perimeter or shape. However, the grip portion 112 may be substantially any size and shape.

A fin 122 (see FIG. 1C) may also be coupled to a bottom surface 120 of the SUP 100. The fin 122 helps maintain the direction and stability of the SUP 100 when in motion.

Figure 1B:
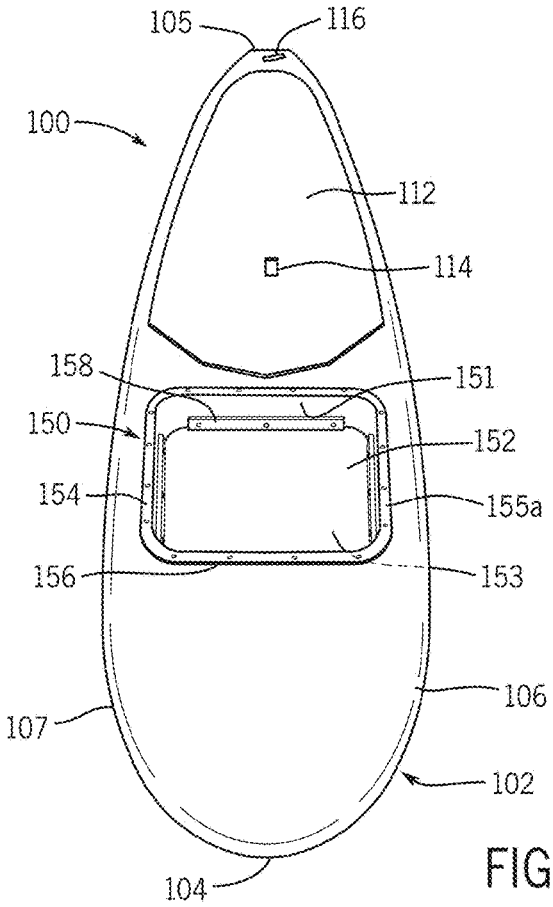
Figure 1C:
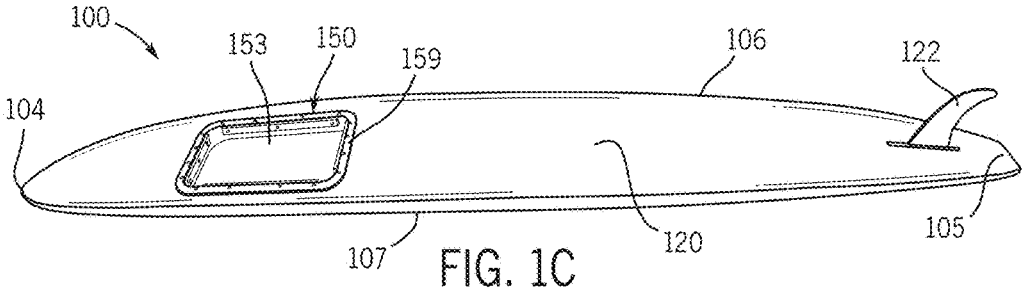
Figure 1D:
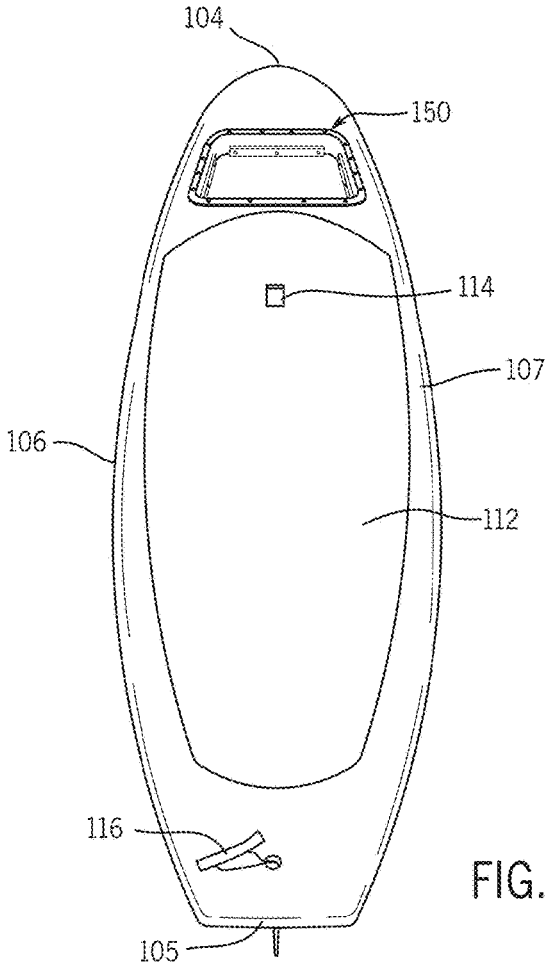

As shown in FIG. 1D, a strap, tether or leash 116 may be secured to the top surface 110 and may be configured to removably attach to a user (e.g., by securing around a user's leg or wrist). Although shown as being positioned near the rear edge 105, the leash 116 may be attached in any suitable area of the body 102 that allows connection to the user to ensure the user does not become detached from the SUP 100 if the user were to fall into the water during use. The leash 116 may have a connection mechanism, such as hook and loop structure, buckles, snaps, or other types of fasteners that secure the leash 116 to the user. Optionally, the leash 116 may also be formed from an elastic material or otherwise be sufficiently flexible to allow a user to maneuver in the water in the event of a fall and also to allow a user to more easily paddle and operate the board during use without being hindered by the strap attached to the user.

Figure 2A:
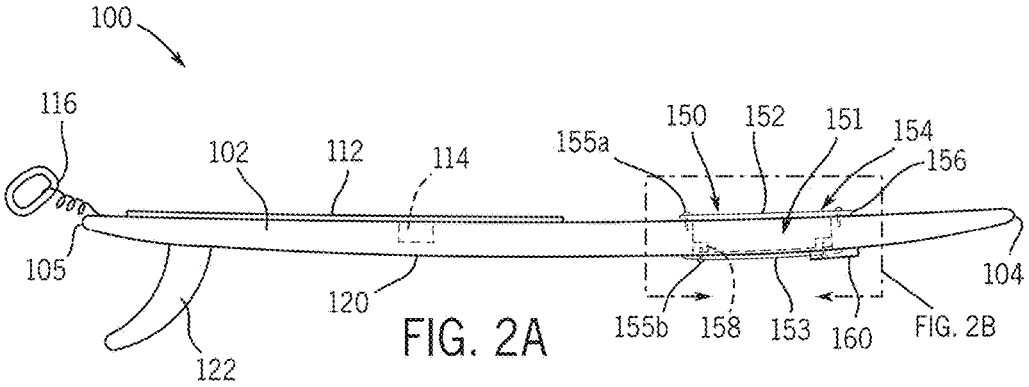
FIG. 2A is a cross-sectional view of the standup paddleboard of FIG. 1.
Figure 2B:
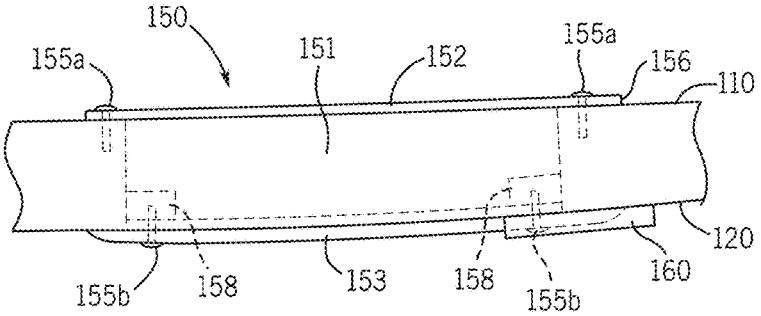
FIG. 2B is an enlarged view of a portion of the standup paddleboard of FIG. 2A.
Figure 3:
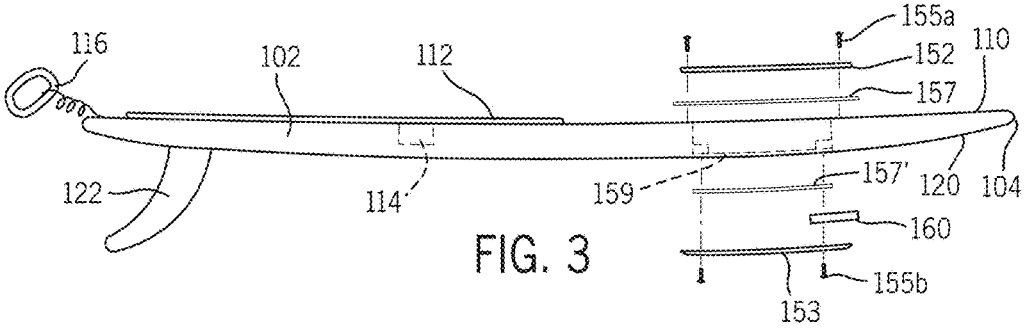
FIG. 3 is a partially exploded cross-sectional view of the standup paddleboard of FIG. 1.

With reference to FIGS. 1B-3, the SUP 100 may include a viewport assembly 150 allowing a user to view an environment or area under the SUP 100, such as an underwater environment. The viewport assembly 150, which may be referred to as a viewing window assembly or simply a viewport, and includes a top panel 152 and a bottom panel 153 connected to a top end and bottom end of the window aperture 151, respectively. Each of the top and bottom panels 152, 153 may be considered a window panel. As shown in FIG. 3, a recessed area 159 may be provided in the bottom surface 120 and/or the window aperture 151, the recessed area 159 is shaped to substantially match the shape and size of the bottom panel 153. The top and bottom panels 152, 153 are made of a transparent material such as polycarbonate (PC), poly (methyl methacrylate) (PMMA), acrylic, Plexiglas™, or the like, to allow an environment below the bottom surface 120 of the SUP 100 to be visible from above the top surface 110, while also not affecting the performance of the SUP 100.

The top panel 152, which may be referred to as a first panel, is shaped to correspond to the window aperture 151 and in examples where the window aperture 151 has rounded corners, the top panel 152 may as well (or otherwise be configured to match the shape of the window aperture 151). Additionally, the top panel 152 may be substantially flat and sized such that it overhangs the perimeter of the window aperture 151 to form an overhang or bezel 154. The window aperture 151 may have rounded corners to increase structural rigidity and reduce separation of panels 152,153, as well as form a tighter fit, as compared with fitting the panel with butt joints (square-shaped joints or corners). In some examples, as shown in FIG. 1B, the top panel 152 is not flush with a top surface 110 of the SUP 100, and instead forms a water or debris barrier 156, as discussed in more detail below. However, the top panel 152 may be provided flush with or countersunk into (e.g., at least partially recessed within) the top surface 110 of the SUP 100 or in other manners as desired.

The bottom panel 153, which may be referred to as a second panel, forms a bottom portion of the viewport assembly 150 and also interfaces with the water surface. The bottom panel 153 may be made of a similar or the same material to the top panel 152, such as polycarbonate, poly (methyl methacrylate) (PMMA), acrylic, Plexiglas™, or the like, to ensure durability, as well as visibility and clarity. The bottom panel 153 may have rounded corners to ensure a tight connection with the SUP 100 given the shape of the window aperture 151. However, in some examples, the bottom panel 153 of the viewport assembly 150 may be at least partially recessed within the bottom surface 120 of the SUP 100. Fasteners 155*a*, 155*b*, such as screws, nails, rivets, or the like, are included in the viewport assembly 150 and used to secure the top and bottom panels 152, 153 to the body 102 as discussed below. The fasteners 155*a*, 155*b* may be formed from a polyvinyl chloride, nylon, plastic, or other non-deteriorating, non-corroding material to ensure durability in demanding salt water environments.

Additionally, the viewport assembly 150 may also include sealing members, such as top and bottom sealing members 157, 157' that are used to seal the connection between the body 102 and the top and bottom panels 152, 153 to ensure that fluids and debris do not enter into the window aperture 151 or between the two panels 152, 153 during use. The sealing members 157, 157' may also be used to secure the panels 152, 153 to the body 102 as discussed below. The top and bottom sealing members 157, 157' may be made epoxy, glue, fiberglass resin, chemical bonding agents, O-ring, gasket, or the like.

Figure 4:
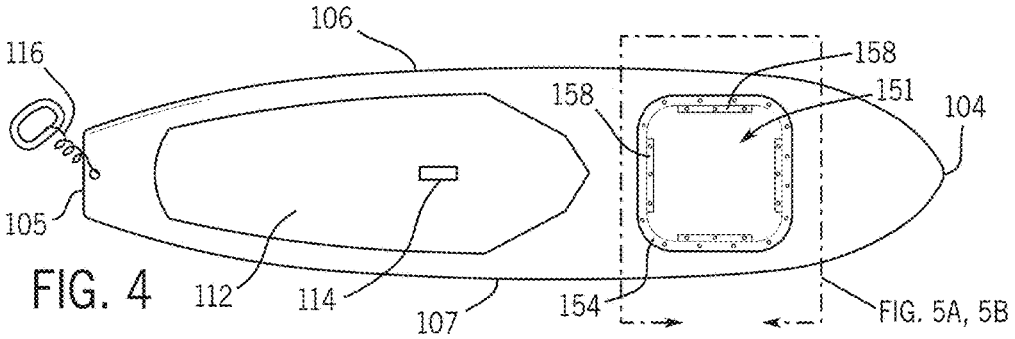
FIG. 4 is a top plan view of the standup paddleboard of FIG. 1.
Figure 5A:
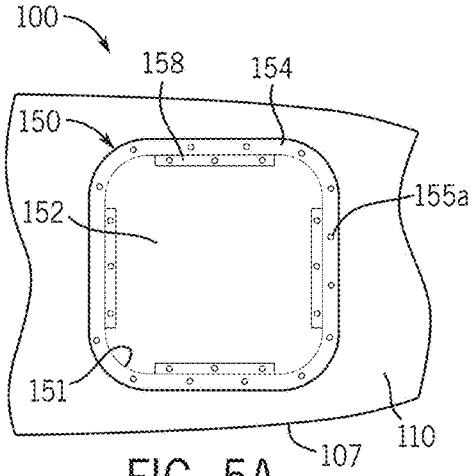
FIG. 5A is an enlarged top view of a portion of the standup paddleboard of FIG. 4.
Figure 5B:
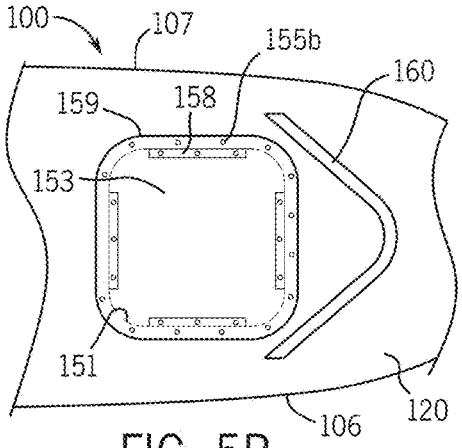
FIG. 5B is an enlarged bottom view of a portion of the standup paddleboard of FIG. 4.

With reference to FIGS. 2-3 and 5B, in some embodiments, a second debris barrier 160 is coupled to the bottom surface 120 of the SUP 100. The second debris barrier 160 helps ensure bubbles and underwater debris, such as seaweed, trash, or the like are limited, such as prevented, from covering the bottom panel 153. That is, in use, the second debris barrier 160 helps keep the bottom panel 153 clear of obstructions to ensure a better view of the underwater environment. In one example, as shown in FIG. 5B, the second debris barrier 160 may have a substantially V-shape or other form to block debris from a particular area and direct the debris away from the area. In other words, the debris barrier 160 can function not only to block debris, but also to direct the debris in a desired direction or to a particular location, such as around the bottom panel 153. However, the second debris barrier 160 may take on any shape capable of properly blocking or redirecting debris and bubbles from occluding the view or becoming trapped beneath the bottom panel 153. In some examples, the second debris barrier 160 may be made of a flexible material, such as a soft or thin plastic, rubber, silicone, bristles, or the like, to reduce drag while the SUP is in use. In other examples the second debris barrier 160 may be made of a rigid material, such as a hardened or reinforced plastic, metal, composites, or the like. The second debris barrier 160 is sized and shaped to effectively block or redirect debris and bubbles while minimizing drag. FIG. 4 shows a top view of the SUP 100 as discussed above in FIGS. 1-3.

Assembly of the SUP and viewport will now be discussed in more detail. With reference to FIG. 3, the viewport assembly 150 may be connected to the body 102 of the SUP 100. First, a top sealing member 157 may be placed on one of the top panel 152 of the viewport assembly 150 or the top surface 110 of the body 102. In some examples, the adhesive layer 157 is applied to only in the bezel area 154 around a perimeter of one or both the window aperture 151 and the top panel 152. However, in some embodiments a transparent adhesive can be used, and the top sealing member 157 may be applied to an entire bottom surface of the top panel 152 prior to securing the panel 152.

The top sealing member 157 may be applied, such as by dispensing or positioning the top sealing member 157 in a bezel area 154, prior to coupling the top panel 152 with the SUP 100. Alternatively, the top sealing member 157 may be applied to the top panel 152 prior to coupling the top panel 152 with the SUP 100. Once the top sealing member 157 and top panel 152 are coupled to the top surface 110 of the SUP 100, fasteners 155*a* may be inserted to help secure the top panel 152 to the SUP 100. By using fasteners 155*a* and a top sealing member 157, a watertight seal is made. Fasteners 155*a* be coupled with corresponding pre-drilled holes in the top surface 110 and top panel 152, or may be self-tapping or self-drilling such that they pass through the top panel 152 and top surface 110 to be secured into the material of the body 102.

In some examples, the fasteners 155*a* are inserted around a perimeter and/or in the corner portions of the top panel 152 and secured through the top panel 152 in a bezel area 154 (see FIG. 4-5). That is, the fasteners 155*a* are positioned to extend through the outer edge of the top panel 152 that extends over the top surface 110 surrounding the window aperture 151. In this manner, the fasteners 155*a* secure the top panel 152 to the body 102 and act as a second fastening feature, in addition to the top sealing member 157, that is used to connect the top panel 152 to the body 102 and secure the top panel 152 in position.

That is, when the top panel 152 is secured to the body 102, a hermetic seal is defined around the window aperture 151 to prevent fluids from entering into the window aperture 151, which as discussed below will help in preventing debris or other obstructions from obscuring a user's view through the viewport assembly 150.

As shown in FIG. 2B, when connected to the top surface 110, the top panel 152 of the viewport assembly 150 may be raised above or extend beyond the top surface 110 of the SUP 100. This allows a perimeter of the top panel 152 to form a water and debris barrier 156 to help prevent the top panel 152 from be occluded or blocked during use, and thus provide a clear view of the underwater environment.

Figure 6:
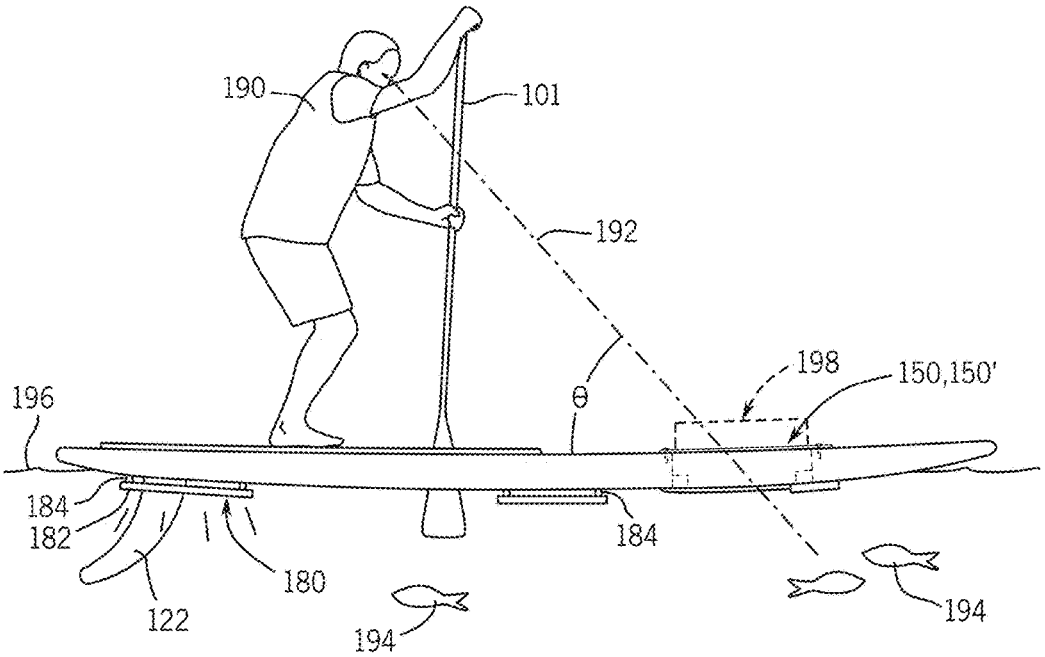
FIG. 6 is a side view of the paddleboard of FIG. 1 in use by a user.

After the top panel 152 is connected to the body 102 (or before), the bottom panel 153 is secured to the body 102. With reference to FIG. 3, a bottom sealing member 157' is applied to the bottom panel 153, to the walls surrounding the window aperture 151 in the body 102, and/or to the reinforcement members 158. Then, the bottom panel 152 is inserted into the bottom end of the window aperture 151 and fitted into the countersunk recess 159 such that the bottom sealing member 157' is positioned between at least a portion of the bottom panel 153 and the body 102. The bottom sealing member 157' adheres or bonds the bottom panel 153 with the body 102 and/or the reinforcement members 158 of the SUP 100. As discussed above with respect to the top panel 152, in instances where a transparent material is used for the bottom sealing member 157', the transparent sealing material may extend onto viewing areas of the bottom panel 153 (e.g., through a center portion that aligns with the top panel 152 that a user will view through, rather than just areas that are covered by the reinforcement members 158 or other portions of the body 102). An exemplary viewing area 198 is shown in FIG. 6.

Similar to the top sealing member 157, the bottom sealing member 157' may be applied, such as by dispensing or positioning the bottom sealing member 157' in a recessed area 159, along a perimeter of the bottom panel 153, and/or on the reinforcement members 158, prior to coupling the bottom panel 153 with the SUP 100. Alternatively, the bottom sealing member 157' may be applied to the bottom panel 153 prior to coupling the bottom panel 153 with the SUP 100. Once the bottom sealing member 157' and bottom panel 153 are coupled to the recessed area 159 and/or the reinforcement members 158, fasteners 155*b* may be inserted to help secure the bottom panel 153 to the SUP 100. By using fasteners 155*b* and sealing member 157', a watertight, strong seal can be made. Fasteners 155*b* may couple with corresponding pre-drilled holes in the bottom surface 120, reinforcement members 158, and/or bottom panel 153. Alternatively, fasteners 155*b* may be self-tapping or self-drilling such that they pass through the bottom panel 152 to be secured to the material of the body 102 and reinforcement members 158.

In examples including one or more reinforcement members 158, the reinforcement members 158 assist in securing and reinforcing the bottom panel 153 by providing structure, such as a surface, for the bottom sealing member 157' and/or the bottom panel 153 to engage when secured to the body 102. Further, the reinforcement members 158 may extend into the window aperture 151 towards a center area and thus act as a shelf onto which the bottom panel 153 is positioned. As with the top panel 152, in some examples, fasteners 155*b* are inserted into the bottom panel 153 and the reinforcement members 158 and/or the body 102 to further secure the bottom panel 153 to the SUP 100 and form an airtight, watertight, waterproof, hermetic seal with the bottom sealing member 157' to prevent water from intruding the window aperture 151 between the top panel 152 and the bottom panel 153 of the viewport assembly 150. For example, the fasteners 155*b* may be inserted in the reinforcement members 158 and/or the perimeter area of the recess area 159 of the body 102. The fasteners 155*b* may be the same as or similar to the fasteners 155*a* and are likewise selected to be non-deteriorating and non-corrosive in water and marine environments.

As shown in FIG. 2B, the bottom panel 153 may be secured to a bottom of the SUP 100 within the recess 159 such that the bottom panel 153 is essentially flush with the bottom surface 120. By maintaining a flush surface, drag due to the bottom panel 153 can be reduced, such that the viewport assembly 150 will not affect the performance of the SUP 100. Further, by using the sealing members 157, 157' and optionally the fasteners 155*a*, 155*b*, a water-tight seal is defined around the viewport assembly 150, eliminating the need for purge valves to remove water from the area between panels 152, 153, and the need to clean interior surfaces since debris may not enter into the enclosed space between the two panels 152, 153. This leads to longer times between maintenance, reducing costs of ownership of the SUP 100, and also allows for clearer views for a user. Further, the viewport assembly 150 can be easily repaired or replaced should damage occur during handling, storage, or use. In particular, each of the components can be removed and separately replaced, without requiring replacement of the entire viewport assembly 150. For example, the top panel 152 and the bottom panel 153 may each be selectively removed without requiring removal of the other. Thus, if one of the panels 152, 153 becomes damaged, then only the damaged panel needs to be replaced. Further, over time if the sealing members 157, 157' become damaged or ineffective, the viewport assembly 150 can be easily disassembled to replace only the defective or damaged portions, such as the sealing members 157, 157', as needed. This increases the useful life of the SUP 100, as damage to a viewport 150 does not require replacement of the SUP 100. This is especially beneficial, for example, in commercial watercraft rental markets, where many SUPs 100 may be owned and subjected to repeated use, sometimes by inexperienced users.

FIG. 6 shows a user 190 using an example of the SUP 100 discussed above. With reference to FIG. 6, to use the SUP 100, a user 190 stands on the grip portion 112 while using a paddle 101 to propel the SUP 100 in various directions adjacent, such as on top of, the water surface 196. As shown in FIG. 6, due to the viewport assembly 150, the user 190 has a line of sight 192 through the body of the SUP 100 and into the area beneath the SUP 100, thereby permitting the user to see (e.g., clearly) the environment under the SUP 100. This provides an exciting and unique experience for users 190 of all ages, who may endeavor to search for new or more marine life 194, such as fish, turtles, coral, and the like, in addition to simply using the SUP 100 for recreation or exercise. The bottom panel 153 interfaces with the water directly to provide a clear viewing window to the environment beneath the SUP 100, and due to the direct engagement of the bottom panel 153 with the water, turbulence or debris floating on the top of the water will not affect the view of the user of the underwater environment.

As can be seen from FIG. 6, since the user 190 of the SUP 100 is in an upright or standing position, the line of sight 192 is at a greater angle than other watercraft, and the apparent size of the viewing area 198 of the panels 152, 153 of viewport assembly 150 is also greatly increased. That is, since the line of sight 192 from a user's eyes to the viewing area 198 forms a larger viewing angle Θ with the surface of the water, a user 190 has a unique vantage point which enables the user to view not only an area directly beneath the SUP 100, but also an underwater environment ahead of the SUP 100.

Additionally, in embodiments where the top panel 152 forms a bezel 154 or other blocking edge 156, the top panel 152 acts to block debris from flowing over the viewing area 198, as well as deflecting debris and fluid away from the viewing area 198 to ensure that the user's view remains unobstructed.

Figure 5C:
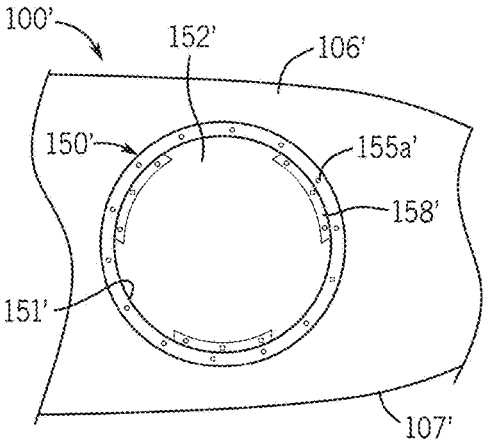
FIG. 5C is an enlarged top view of another example of a portion of the standup paddleboard of FIG. 4.

As mentioned above, in some examples, the viewport assembly 150 may be alternately shaped and sized. FIG. 5C depicts an alternative example of a viewport assembly 150'. The viewport assembly 150' and viewport assembly 150 may be substantially the same except for the shape of the aperture and panels. With reference to FIG. 5C, in this example, the viewport assembly 150' includes top panel 152' and bottom panel 153' formed in a substantially circular shape. Similarly, the window aperture 151' has a circular shape. The viewport assembly 150' further has a bezel portion 154' overhanging the perimeter of the window aperture 151' and includes fasteners 155*a'* to secure the top panel 152' to the top surface 110' of the SUP 100'. It is noted that although rectangular and circular shapes for the window aperture 151, 151' have been discussed, the perimeter of the window aperture 151, 151' and corresponding panels 152, 152', 153, 153' may be formed in substantially any shape, including contoured shapes, polygons, irregular shapes, and the like.

Figure 7A:
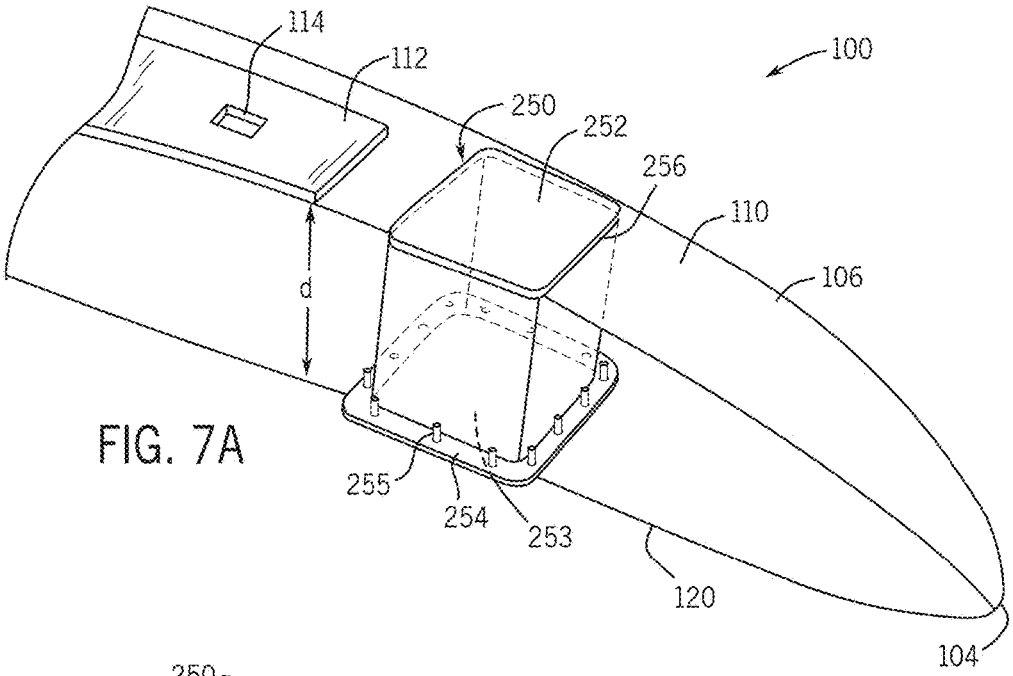
FIG. 7A is a partial cross-sectional view of another example of the standup paddleboard of FIG. 4.
Figure 7B:
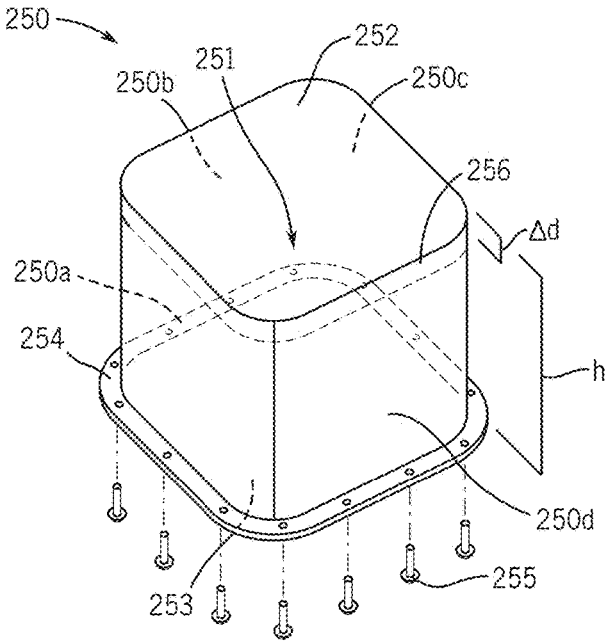
FIG. 7B is an isolated view of a portion of the standup paddleboard of FIG. 7A.
Figure 8:
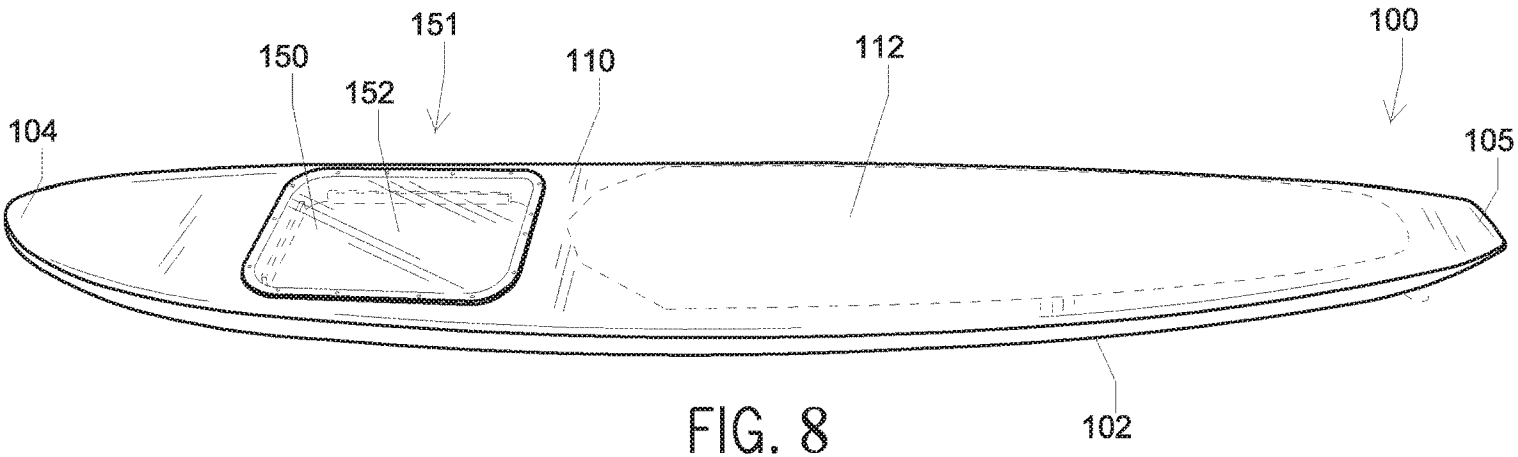
FIGS. 8-16 illustrate various views of another example of the standup paddleboard.
Figure 9:
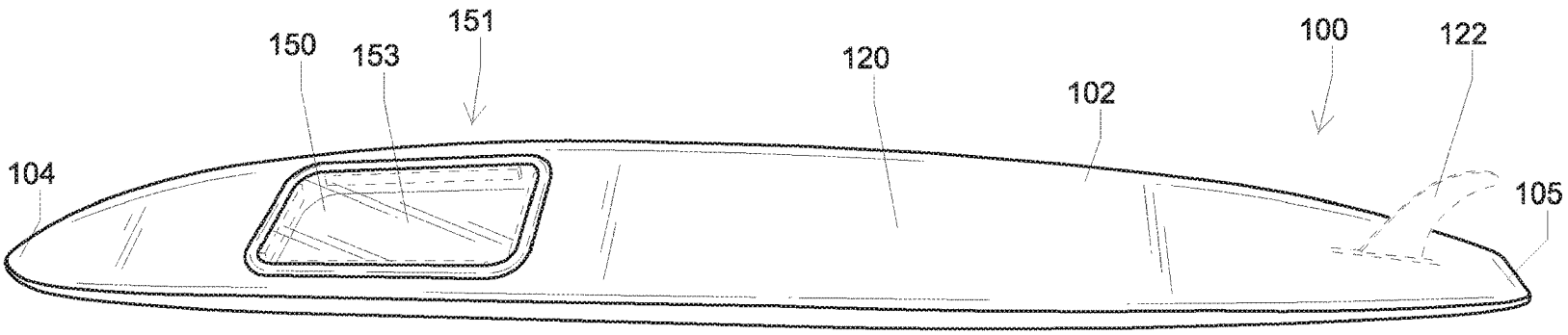
Figure 10:
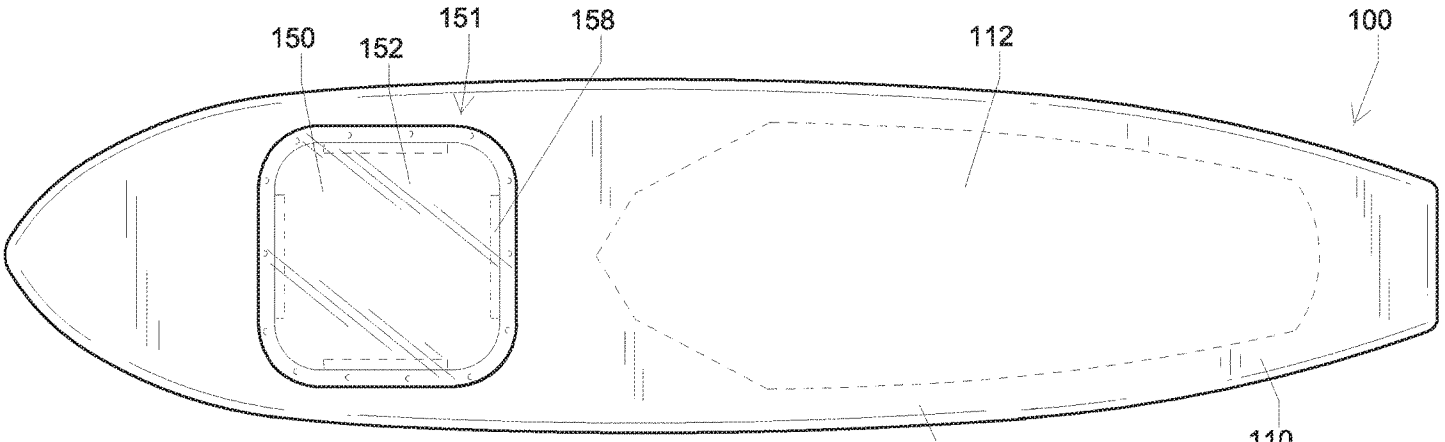
Figure 11:
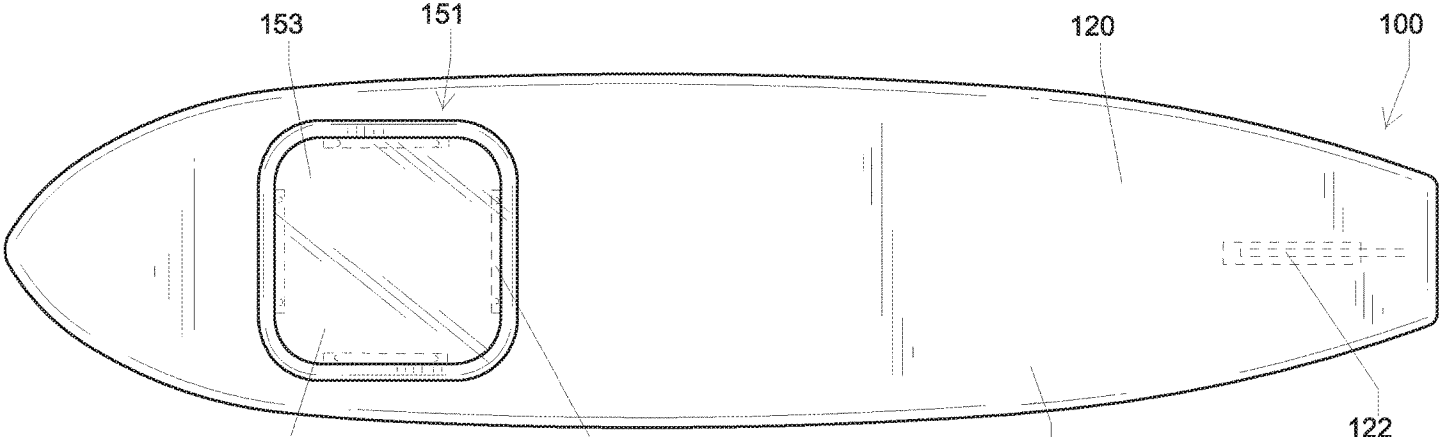
Figure 12:
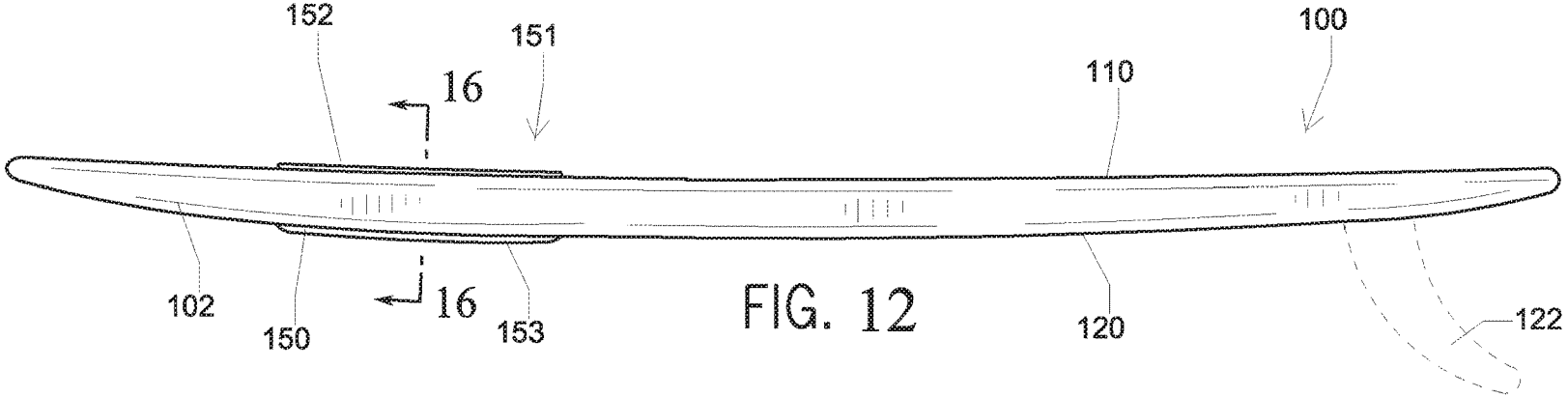
Figure 13:
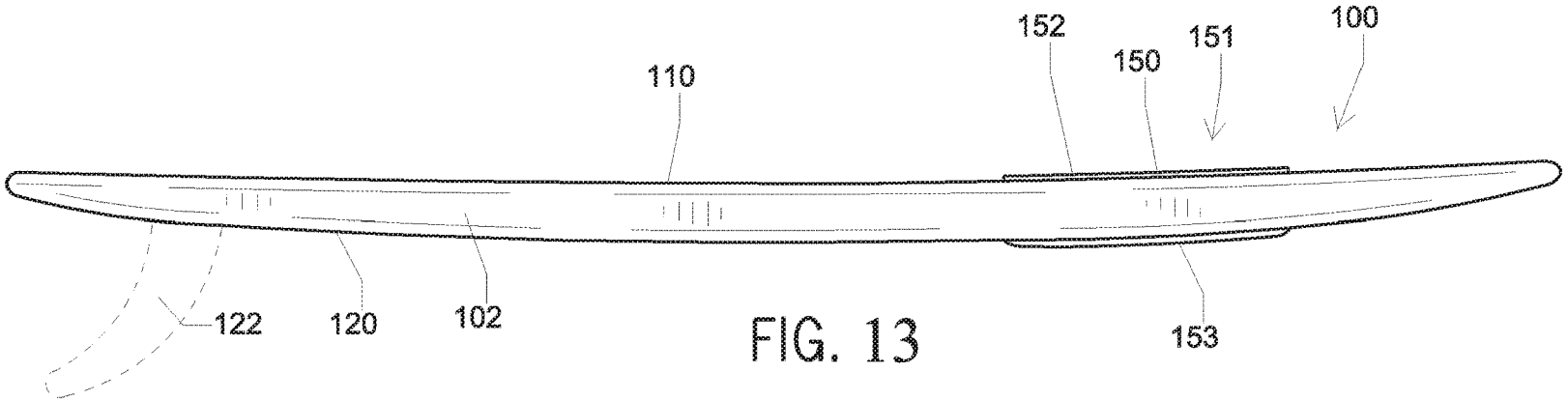
Figure 15:
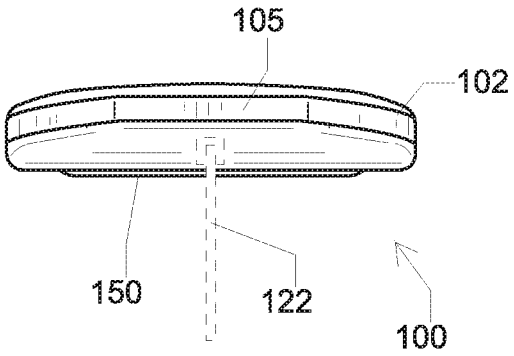
Figure 14:
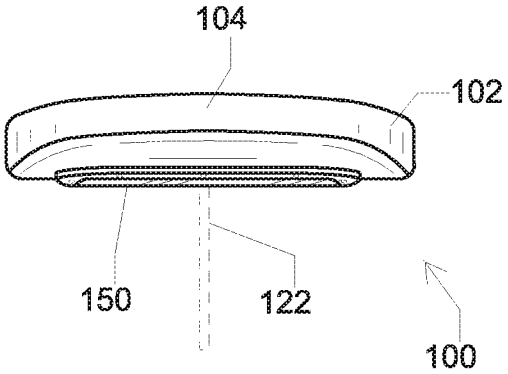
Figure 16:
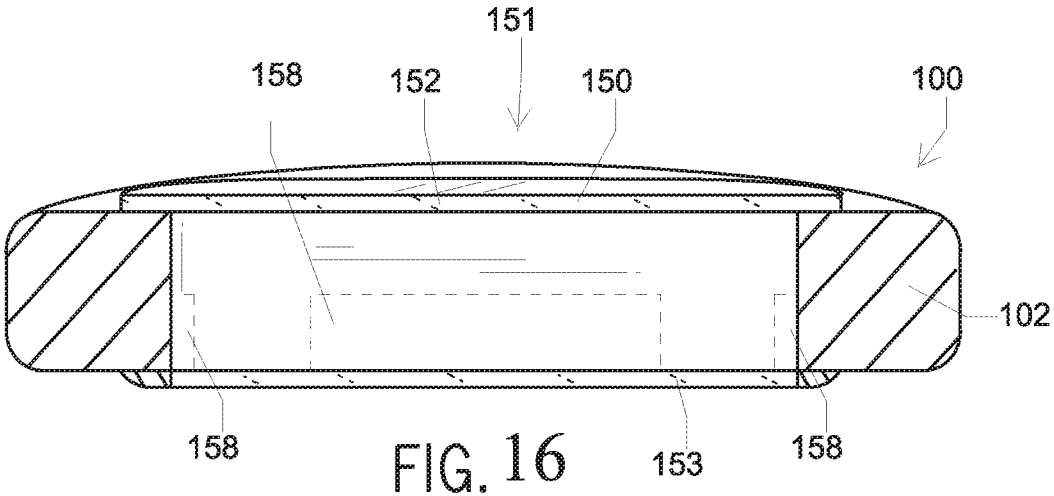

Turning briefly to FIGS. 7A-7B, in another example of the SUP 100, a viewport assembly 150 may be installed into a SUP 100 via an assembly kit 250, which may be referred to as a viewport assembly kit. FIG. 7A is a partial cross-section of a SUP 100 having a viewport assembly 150 assembled using the assembly kit 250. FIG. 7B is a view of the viewport assembly kit 250 removed from the SUP 100. The viewport assembly kit 250 may be substantially similar to the viewport assemblies 150, 150' discussed above, and be constructed of durable, transparent materials such as PC, acrylic, or the like. However, the viewport assembly 250 is configured to be assembled together and then installed/connected to the body 102 of the SUP 100. For example, the viewport assembly kit 250 can be sold as a separate element having each of the components of the viewport assembly 150 and users can install a viewport into their own SUP by cutting the window aperture 151 and then installing the assembly kit 250. This allows users to retrofit their own boards and also allows manufactures to more easily incorporate a viewport assembly 150 into prefabricated boards.

The viewport assembly kit 250 includes each of the components used to define the viewport assembly 150 and to install it into the SUP 100. However, each of the components may be disassembled in a package and then connected together by a user. As another example, the viewport assembly kit 250 may include an assembled viewport that is then connected to a body 102 of a SUP 100 to allow a quick and easy installation process for the user.

As shown in FIG. 7A, the viewport assembly kit 250 may have a top panel 252, a bottom panel 253, and a plurality of connection panels 250*a-d*. It is noted that similar to other examples, although the panels 252, 253 are shown with a rectangular shape, the panels 252, 253 may form substantially any shape, including polygonal, circular, and contouring shapes. Connection panels 250*a-d* may be coupled to one another to form a hollow space 251 therebetween. In some examples, connection panels 250*a-d* are formed as one piece. In other examples connection panels 250*a*-250*d* are separate panels coupled together by using mechanisms such as adhesive, epoxy, welding, or the like. The hollow space 251 may correspond to or otherwise be substantially the same volume as the space formed by the window aperture 151. That is, the connection panels 250*a-d* may fit flush within the window aperture 151.

The connection panels 250*a*-250*d* may further be coupled to the top panel 252 at one end and the bottom panel 253 at an opposing end. The connection panels 250*a-d* and panels 252, 253 maybe coupled by using an adhesive, epoxy, welding, or the like. Connection panels 250*a*-250*d* may have a height h corresponding to the thickness d of the SUP 100. The top panel 252 may protrude from a top surface 110 to form a debris barrier 256. The debris barrier 256 may be formed by a thickness Δd of the top panel 252 protruding from the top surface 110. Accordingly, the viewport assembly kit 250 may have an overall height of h+Δd, which is greater than the thickness d. If the thickness d varies across a width or length of the SUP 100, the height h of one or more connection panels 250*a*-250*d* may vary accordingly.

As shown in FIG. 7B, the bottom panel 253 may be larger than the top panel 252 so as to form a bezel 254. The bezel 254 may fit within the recessed area 159 (see FIG. 3) in order to maintain a flush surface with the bottom surface 120 of the SUP 100. In this example, reinforcement members 158 may not be necessary, and may therefore be omitted from the window aperture 151. As discussed above, the window aperture 151 may be pre-fabricated or may be formed by a user after manufacture of the SUP 100.

During assembly, the connection panels 250*a-d*, which may be separate panels, are coupled to one another to form the hollow space 251. The connection panels 250*a-d* may be shaped to substantially match the shape of the window aperture 151, and accordingly may have various shapes and contours to match the window aperture 151. After connection panels 250*a-d* are coupled to one another, the connection panels 250*ad* may be coupled to a bottom panel 253 by adhesive, epoxy, welding, or the like. The top panel 252 is then coupled to the assembly of the bottom panel 253 and connection panels 250*a-d*.

Accordingly, as shown in FIG. 7B, the viewport assembly kit 250 may form a cuboid shape which substantially corresponds to the shape and size of the window aperture 151. Since the panels 252, 253, and 250*a-d* are coupled to one another using adhesive, epoxy, or welds, the hollow area 251 forms a waterproof, airtight, or hermetic seal. Once assembled, as in FIG. 7B, the viewport assembly kit 250 may be inserted into the window aperture 151, as shown in FIG. 7A, and secured to the SUP 100 by fasteners 255 passing through the bezel 254 and securing to the bottom surface 120 of the SUP 100. Fasteners 255 may be formed from a polyvinyl chloride, nylon, plastic, or other non-deteriorating, non-corroding material to ensure durability in demanding salt water environments. In some examples, a seal (not shown) may be provided around a bezel portion 254 to ensure water does not enter the window aperture 151. The bezel 252 seal may be formed by an O-ring, epoxy, adhesive, or the like. Although shown in FIG. 7 as being coupled to a bottom surface 120 of the SUP 100, in other examples the viewport assembly kit 250 may be configured to be mounted to a top surface 110. Further, the order of assembling panels 250*a-d*, 252, and 253 to form the viewport assembly kit 250 may vary.

Returning to FIG. 6, in addition to changing the viewport assembly 150 to accommodate a desired viewing angle and the like, other features can be added to the SUP to further increase the visibility of the underwater environment. For example illumination devices may be secured to the SUP 100 to illuminate an underwater environment at night. As shown in FIG. 6, one or more lighting assemblies 180 including at least one light source 182 and one or more light mounts 184 are coupled to the bottom surface 120 of the SUP 100. The light mounts 184 are arranged to be positioned around the viewing area 198 of the SUP 100 and/or the perimeter of the SUP 100 to illuminate a larger perimeter of the environment. The light source 182 may be substantially any type of waterproofed light, including light emitting diodes, fluorescent bulbs, or the like. The lighting assembly 180 may have its own portable power source to power the light source 182. In some examples, the light mounts 184 releasably secure the lighting assemblies 180 to the SUP 100 such that they can be removed when not in use. In some examples, the light mounts 184 are straps configured securely hold the lighting assemblies 180 and wrap around the body 102 of the SUP 100. In other examples, the light mounts 184 are reversible mounts, such as threaded mounts, which allow the lighting assemblies 180 to be easily removed or replaced. In other examples, each of the lighting assemblies 180 may be secured to the SUP 100 by a strap, belt, or the like.

With the lighting assembly 180, users will have a unique experience for viewing the underwater environment as objects in the environment will be illuminated and thus easier to use, especially during night-time and twilight excursions. As discussed above, the relatively high viewpoint of a user 190 enables the user to pilot the SUP 100 using a paddle 101 or the like while being able to have a line of sight 192 with a marine environment under the surface 196 of the water. When users desire to use the SUP 100 at night or near twilight, the lighting assemblies 180 may be mounted such that the water beneath the SUP 100 is illuminated, allowing the user 190 to view marine life 194 such as fish, coral, and the like beneath the SUP 100. This provides a one-of-a-kind experience enjoyable by all ages, and allows users 190 to view marine life 194 which may not otherwise venture close to the surface 196 of the water during the day.

Although examples of the present disclosure have been discussed above with respect to having one viewport assembly 150, more than one viewport assembly 150 may be provided. Further, the position of the viewport assembly 150 may be selected based on a desired visibility angle though the viewport assembly 150. For example, for longer SUPs 100, the viewport assembly 150 may be placed more central to ensure the user 190 can see the underwater environment, whereas shorter SUPs 100 may necessitate the viewport assembly 150 be placed nearer to the tip 104 of the SUP 100. Further, the size of the viewport assembly 150 may be adjusted to ensure proper visibility through the viewport assembly 150.

As discussed above, the top panel 152 and the bottom panel 153 may be made of polycarbonate (PC), poly(methyl methacrylate) (PMMA), acrylic, Plexiglas, or the like. The viewport assembly 150 may in some examples be positioned beneath a user 190 and support the user's weight. Acrylic is approximately four to eight times stronger than traditional glass, and PC is approximately two-hundred times stronger than traditional glass, or more than twenty-five times stronger than acrylic. Accordingly, if additional strength is desired, in some examples the panels 152, 153 are made of these materials to ensure they are capable of holding the weight of a user, absorbing impacts on the top panel 152, and/or absorbing forces due to water, waves, and debris on a bottom panel 153 while remaining transparent for the user. As discussed above, the SUP 100 may be pre-manufactured with the window aperture 151 and reinforcement members 158 already formed therein, or the viewport assembly 150 may be retro-fitted to an existing SUP by cutting or otherwise forming the window aperture 151 and reinforcement members 158, thus allowing for more flexibility for personal and commercial users.

FIGS. 8-16 illustrate various views of an additional embodiment of the SUP 100 in accordance with the present disclosure. Like reference numbers are used for similar features already discussed. In addition, FIGS. 8-16 illustrate how the grip portion 112, the fin 122, and the reinforcement members 158 may be included or omitted from the SUP 100 depending on the particular application. For instance, the fin 122 may be omitted from the SUP 100 to decrease lateral stability of the SUP 100 and/or provide a varying level of directional control, if desired. In like manner, the grip portion 112 may be omitted from the SUP 100 to alter the feel or frictional engagement between a user and the top surface 110 of the SUP 100, as a user may prefer to apply a wax or other coating as a personal preference. Additionally or alternatively, the reinforcement members 158 may be omitted from the viewport assembly 150 to increase the viewing area 198, thereby increasing the field of vision of an underwater environment.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of the present disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order and relative sizes reflected in the drawings attached hereto may vary.

The above specification and examples provide a complete description of the structure and use of exemplary embodiments of the disclosure as defined in the claims. Although various embodiments of the claimed disclosure have been described above with a certain degree of particularity, or with reference to one or more individual embodiments, those skilled in the art could make numerous alterations to the disclosed embodiments without departing from the spirit or scope of the claimed invention. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the present disclosure as defined in the following claims.

What is claimed is:

1. A standup paddleboard comprising:

a solid buoyant material defining a body having a standing surface and an opposing bottom surface, each defining external surfaces of the standup paddle board;

a window aperture defined through the solid buoyant material and extending between the standing surface and the bottom surface, the solid buoyant material defining water-impervious internal walls of the window aperture between the standing and bottom surfaces, the solid buoyant material extending substantially uninterrupted from the water-impervious internal walls to contoured external sides of the body;

a viewport assembly comprising:

a first panel coupled to the standing surface; and a second panel coupled to the bottom surface, wherein the first and second panels overhang a perimeter of the window aperture forming bezels allowing the first panel to directly contact or adhere to the standing surface and allowing the second panel to directly contact or adhere to the opposing bottom surface, thereby cooperating with the water-impervious internal walls to seal the window aperture from air and water infiltration;

a receptacle coupled with the body on the opposing bottom surface; and a light source coupled to the body via the receptacle, the light source configured to illuminate an environment around the viewport assembly.

2. The standup paddleboard of claim 1, wherein:

the first panel and the second panel are substantially planar; and the standing surface and the opposing bottom surface each define curved external surfaces of the standup paddle board.

3. The standup paddle board of claim 2, wherein:

the body has a body width and a body length;

the window aperture has a window aperture width that extends across a majority of the body width; and the window aperture further has a window aperture length that extends along the body length and is equal to or greater than the window aperture width.

4. The standup paddle board of claim 3, further comprising a sealing member formed over the bezel and defining:

an impermeable barrier between the window aperture and the external environment; and a smooth transition between the first panel and a portion of the standing surface adjacent the first panel.

5. The standup paddleboard of claim 1, wherein the first panel and the second panel are made of polycarbonate.

6. The standup paddleboard of claim 1, wherein:

the first panel is coupled to the standing surface with at least one fastener; and the second panel is coupled to a reinforcement structure provided in the window aperture.

7. The standup paddleboard of claim 1, wherein each of the first and second panels is transparent.

8. The standup paddleboard of claim 1, wherein the first panel is at least partially recessed into the body.

9. The standup paddleboard of claim 1, wherein the second panel is at least partially recessed within the bottom surface of the body.

10. The standup paddleboard of claim 9, wherein the second panel is secured to one or more reinforcement members positioned within the window aperture.

11. The standup paddleboard of claim 9, wherein the second panel is flush with the bottom surface of the body.

12. The standup paddleboard of claim 1, wherein the connection between the body and each of the first and second panels is sealed via a sealing member positioned at least partially between the body and each of the first and second panels.

13. The standup paddleboard of claim 1, further comprising a debris barrier coupled to the bottom surface of the body to limit underwater debris from covering the second panel.

14. The standup paddleboard of claim 13, wherein the debris barrier directs the underwater debris around the second panel.

15. A standup paddleboard comprising:

a body formed from a solid buoyant material, the body defining:

a standing surface and a bottom surface opposite the standing surface, each being external surfaces of the standup paddle board and surrounded by contoured external sides; and a window aperture formed through the body and extending between the standing surface and the bottom surface, wherein edges of the body along the standing surface and the bottom surface define a perimeter of the window aperture, and wherein the buoyant material forms internal surfaces of the window aperture and extends substantially uninterrupted from the internal surface to the contoured external sides and the standing and bottom surfaces of the body;

a first substantially planar panel coupled to the body and overlapping the standing surface, an overlapping portion of the first substantially planar panel and the standing surface defining a first bezeled region encompassing the perimeter of the window aperture; and a second substantially planar panel coupled to the body and overlapping the bottom surface, an overlapping portion of the second substantially planar panel and the bottom surface defining a second bezeled region encompassing the perimeter of the window aperture;

wherein one or both of the standing surface and the bottom surface define a curved external surface of the standup paddleboard;

wherein the first bezeled region or the second bezeled region defines an interface allowing for directly contacting or adhering the first or second substantially planar panel to a respective curved external surface of the standup paddleboard;

wherein the window aperture defines a water-impervious internal region of the standup paddle board in which the internal surfaces that are defined by the solid buoyant material, the first substantially planar panel, and the second substantially planar panel each cooperate to prevent air and water infiltration into the water-impervious region.

16. The standup paddle board of claim 15, wherein the internal surfaces within the window aperture define a uniform width of the window aperture at each of a plurality of depth positions of the body extending between the standing surface and the bottom surface.

17. The standup paddle board of claim 15, wherein the interior walls are sustainably opaque.

18. The standup paddle board of claim 15, wherein the first panel and the second panel are formed from a polycarbonate material.

19. The standup paddle board of claim 18, wherein the polycarbonate material is configured to match a structural-weight capacity of the body.

20. The standup paddle board of claim 15, further comprising a light source releasably attached to the body on the bottom surface.

* * * * *